US009677523B2

(12) United States Patent
Manring et al.

(10) Patent No.: US 9,677,523 B2
(45) Date of Patent: Jun. 13, 2017

(54) FUEL INJECTOR INCLUDING AN INJECTION CONTROL VALVE HAVING AN IMPROVED STATOR CORE

(71) Applicant: CUMMINS, INC., Columbus, IN (US)

(72) Inventors: Edward B. Manring, Columbus, IN (US); Donald J. Benson, Columbus, IN (US); Martin W. Long, Columbus, IN (US); Michael W. Lucas, Columbus, IN (US)

(73) Assignee: CUMMINS INC., Columbus, IN (US)

( * ) Notice: Subject to any disclaimer, the term of this patent is extended or adjusted under 35 U.S.C. 154(b) by 242 days.

(21) Appl. No.: 14/292,059

(22) Filed: May 30, 2014

(65) Prior Publication Data

US 2015/0345442 A1 Dec. 3, 2015

(51) Int. Cl.

| | |
|---|---|
| ***F02M 61/16*** | (2006.01) |
| ***H01F 7/08*** | (2006.01) |
| ***F02M 47/02*** | (2006.01) |
| ***F02M 63/00*** | (2006.01) |
| *H01F 7/11* | (2006.01) |
| *H01F 7/16* | (2006.01) |

(52) U.S. Cl.

CPC ..... *F02M 61/168* (2013.01); *F02M 47/027* (2013.01); *F02M 63/0019* (2013.01); *F02M 2200/08* (2013.01); *F02M 2200/8038* (2013.01); *H01F 7/11* (2013.01); *H01F 2007/085* (2013.01); *H01F 2007/1676* (2013.01); *Y10T 29/49435* (2015.01)

(58) Field of Classification Search

CPC ..... F02M 61/168; F02M 47/027; F02M 63/0019; F02M 2200/08; F02M 2200/8038; H01F 2007/1676; H01F 2007/085; H01F 7/081; H01F 7/11; H01F 7/1638; F16K 31/0655

USPC ..... 251/129.16, 129.15; 335/279–281, 301

See application file for complete search history.

(56) References Cited

U.S. PATENT DOCUMENTS

| | | | | |
|---|---|---|---|---|
| 2,952,801 A * | 9/1960 | Hyink | ..... | H01F 7/1205 29/602.1 |
| 2,993,103 A * | 7/1961 | Zimmer | ..... | H01H 51/287 335/162 |
| 2,993,104 A * | 7/1961 | Zimmer | ..... | H01H 51/287 335/154 |

(Continued)

FOREIGN PATENT DOCUMENTS

| | | | | |
|---|---|---|---|---|
| CH | DE 3734542 A1 * | 4/1988 | ..... | H01F 7/1638 |
| DE | 10235240 A1 * | 2/2004 | ..... | F02M 47/027 |
| EP | 2752858 * | 7/2014 | ..... | H01F 3/08 |

*Primary Examiner* — Kevin Murphy
*Assistant Examiner* — David Colon Morales
(74) *Attorney, Agent, or Firm* — Faegre Baker Daniels LLP

(57) ABSTRACT

A fuel injector includes an injection control valve having a stator core that is electrically isolated from surrounding parts such as a stator housing. The stator core includes a first annulated wall having an inner surface, a second annulated wall having an outer surface, a radially extending wall connecting the first and second annulated wall, and a radially extending slot extending through the first annulated wall, the radially extending wall, and the second annulated wall. The stator core may include a limited number of contact points with the stator housing. Alternatively or additionally, an electrically insulating material may be placed between the stator core and the stator housing.

18 Claims, 6 Drawing Sheets

(56) References Cited

U.S. PATENT DOCUMENTS 3,189,858 A * 6/1965 Moore ..... H01F 27/245 335/281
3,241,005 A * 3/1966 Morris, Jr. ..... H01F 7/1607 335/261
3,633,139 A 1/1972 Thompson
4,025,887 A 5/1977 Romans
4,295,553 A * 10/1981 Sayo ..... F16D 27/112 192/84.961
4,390,857 A * 6/1983 Kubach ..... F02M 51/0625 335/281
4,443,775 A * 4/1984 Fujitani ..... H01F 7/1607 335/251
4,476,451 A 10/1984 Kosugi
4,810,985 A * 3/1989 Mesenich ..... F02M 51/0625 335/261
4,830,286 A * 5/1989 Asslaender ..... F02M 51/065 239/585.3
5,032,826 A 7/1991 Miller et al.
5,155,461 A * 10/1992 Teerman ..... F02M 63/0019 29/602.1
5,280,873 A * 1/1994 Abrahamsen ..... H01F 7/081 251/129.15
5,310,160 A * 5/1994 Harck ..... H01F 7/081 137/269
5,339,063 A * 8/1994 Pham ..... F02M 57/02 239/585.1
5,405,050 A * 4/1995 Walsh ..... B67D 3/043 222/1
5,513,832 A * 5/1996 Becker ..... F16K 31/0624 137/82
5,566,921 A * 10/1996 Yokota ..... F02M 59/466 239/585.3
5,926,082 A * 7/1999 Coleman ..... H01F 7/081 239/585.1
5,927,614 A * 7/1999 Touvelle ..... F02M 51/005 239/585.1
6,056,264 A * 5/2000 Benson ..... F02M 47/027 251/129.15
6,119,966 A * 9/2000 Wagner ..... F02M 47/027 239/585.1
6,155,503 A 12/2000 Benson et al.
6,322,048 B1 11/2001 Gramann et al.
6,764,061 B2 * 7/2004 Haeberer ..... F02M 47/027 251/129.16
6,793,196 B2 * 9/2004 VanWeelden ..... F02M 59/366 251/129.07
6,807,943 B2 * 10/2004 VanWeelden ..... F02M 59/366 123/458
6,848,669 B2 * 2/2005 Makino ..... F02M 63/0019 251/129.15
6,982,619 B2 * 1/2006 Nussio ..... F02M 59/366 335/262
6,994,234 B2 * 2/2006 de Leeuw ..... B05C 5/0225 222/1
7,004,450 B2 * 2/2006 Yoshimura ..... F16K 31/0655 251/129.15
7,053,741 B2 5/2006 Tojo et al.
7,084,371 B2 8/2006 Hett et al.
7,156,368 B2 * 1/2007 Lucas ..... F02M 47/027 251/129.18
7,552,719 B2 6/2009 Joshi et al.
7,552,909 B2 * 6/2009 Ricco ..... F02M 47/027 239/533.2
7,646,912 B2 * 1/2010 Hemmert ..... G10L 15/20 382/181
7,946,276 B2 * 5/2011 Pusch ..... F02M 61/166 123/472
8,083,206 B2 * 12/2011 Manubolu ..... F02M 47/027 251/129.15
8,264,313 B2 * 9/2012 Sasao ..... H01F 7/1607 335/278
8,421,566 B2 * 4/2013 Sasao ..... H01F 7/128 335/220
8,427,263 B2 * 4/2013 Hoppe ..... H01F 7/081 335/255
8,436,704 B1 * 5/2013 Venkataraghavan ..... H01F 3/08 251/129.15
2006/0138374 A1 * 6/2006 Lucas ..... F02M 47/027 251/129.16
2008/0156905 A1 * 7/2008 Shafer ..... F02M 63/0015 239/585.1
2008/0232995 A1 9/2008 Ishihara et al.
2009/0267008 A1 * 10/2009 Lucas ..... C23C 18/32 251/129.15
2011/0050376 A1 * 3/2011 Gerster ..... F02M 51/0653 335/281
2012/0153034 A1 * 6/2012 Venkataraghavan F02M 47/027 239/5
2012/0313021 A1 * 12/2012 Da Pont ..... F16K 31/402 251/129.15
2013/0187736 A1 * 7/2013 Staniewicz ..... H01F 7/126 335/281

* cited by examiner

FUEL INJECTOR INCLUDING AN INJECTION CONTROL VALVE HAVING AN IMPROVED STATOR CORE

TECHNICAL FIELD

This disclosure relates to fuel injectors including an injection control valve having a stator.

BACKGROUND

Solenoid actuated fuel injectors are one type of fuel injector used to supply fuel to a combustion chamber of an internal combustion engine. Such fuel injectors are relatively efficient to manufacture, have proven reliability, and are widely available. One characteristic of such fuel injectors is the time it takes to energize and de-energize an actuator that controls a fuel injection event.

SUMMARY

Embodiments of this disclosure include a fuel injector having an injector body and an injection control valve. The injection control valve is positioned in the injector body and includes a stator housing and a stator core. The stator housing includes a first stator housing portion, and at least one of an inner stator housing portion extending longitudinally from the first stator housing portion and an outer stator housing portion extending longitudinally from the first stator housing portion. The stator core includes a first annulated wall having an inner surface, a second annulated wall having an outer surface, a radially extending wall connecting the first annulated wall to the second annulated wall and including an exterior surface, a radially extending slot extending through the first annulated wall, the radially extending wall, and the second annulated wall, and an annular coil assembly positioned between the first annulated wall and the second annulated wall. The stator core is positioned on the stator housing and includes an electrically insulating material separating the radially extending wall exterior surface from the stator housing, and separating at least one of: the first annulated wall from the inner stator housing portion along an extent of the first annulated wall; the second annulated wall from the outer stator housing portion along an extent of the second annulated wall; and the second annulated wall from the injector body along the extent of the second annulated wall.

Embodiments of this disclosure also include a fuel injector having a fuel injector body, a stator housing, and a stator core. The stator housing is positioned in the fuel injector body. The stator core is positioned in the fuel injector body and includes an inner surface, an outer surface, a radially extending slot extending from the inner surface to the outer surface, and an annular coil assembly positioned on the stator core between the inner surface and the outer surface. The stator core is positioned to contact only one of: the stator housing at only one azimuthal location on the inner surface; the stator housing at only one azimuthal location on the outer surface; the fuel injector body at only one azimuthal location on the outer surface; and the stator housing at only one azimuthal location on the transversely extending surface.

Embodiments of this disclosure also include a method of reducing an eddy current in a fuel injector. The method includes positioning a stator housing and a stator core in a fuel injector body of the fuel injector, the stator core including a slot extending radially through the stator core from an inner surface of the stator core through an outer surface of the stator core. The method further comprises positioning the stator core to place the stator core in contact with only one of: the stator housing at only one azimuthal location on the inner surface; the stator housing at only one azimuthal location on the outer surface; the fuel injector body at only one azimuthal location on the outer surface; and the stator housing at only one azimuthal location on the transversely extending surface.

Advantages and features of the embodiments of this disclosure will become more apparent from the following detailed description of exemplary embodiments when viewed in conjunction with the accompanying drawings.

DETAILED DESCRIPTION

Rising or falling magnetic fields in electrically conductive parts of an actuator of a fuel injector may create eddy currents in the actuator, increasing the time it takes to fully open and close a nozzle or needle valve element of the fuel injector, which may lead to non-optimized fuel delivery to the combustion chamber of an engine. Fuel injectors according to embodiments of the present disclosure may facilitate reduction of such eddy currents, which may shorten the time for magnetic flux density to rise when the actuator of the fuel injector is energized, which may cause the nozzle or needle valve element to fully open faster than in conventional fuel injectors. Additionally, this decrease in eddy currents also may cause the actuator to de-energize more quickly than in a conventional fuel injector, which may cause the nozzle or needle valve element to fully close faster than in conventional fuel injectors.

Figure 1:
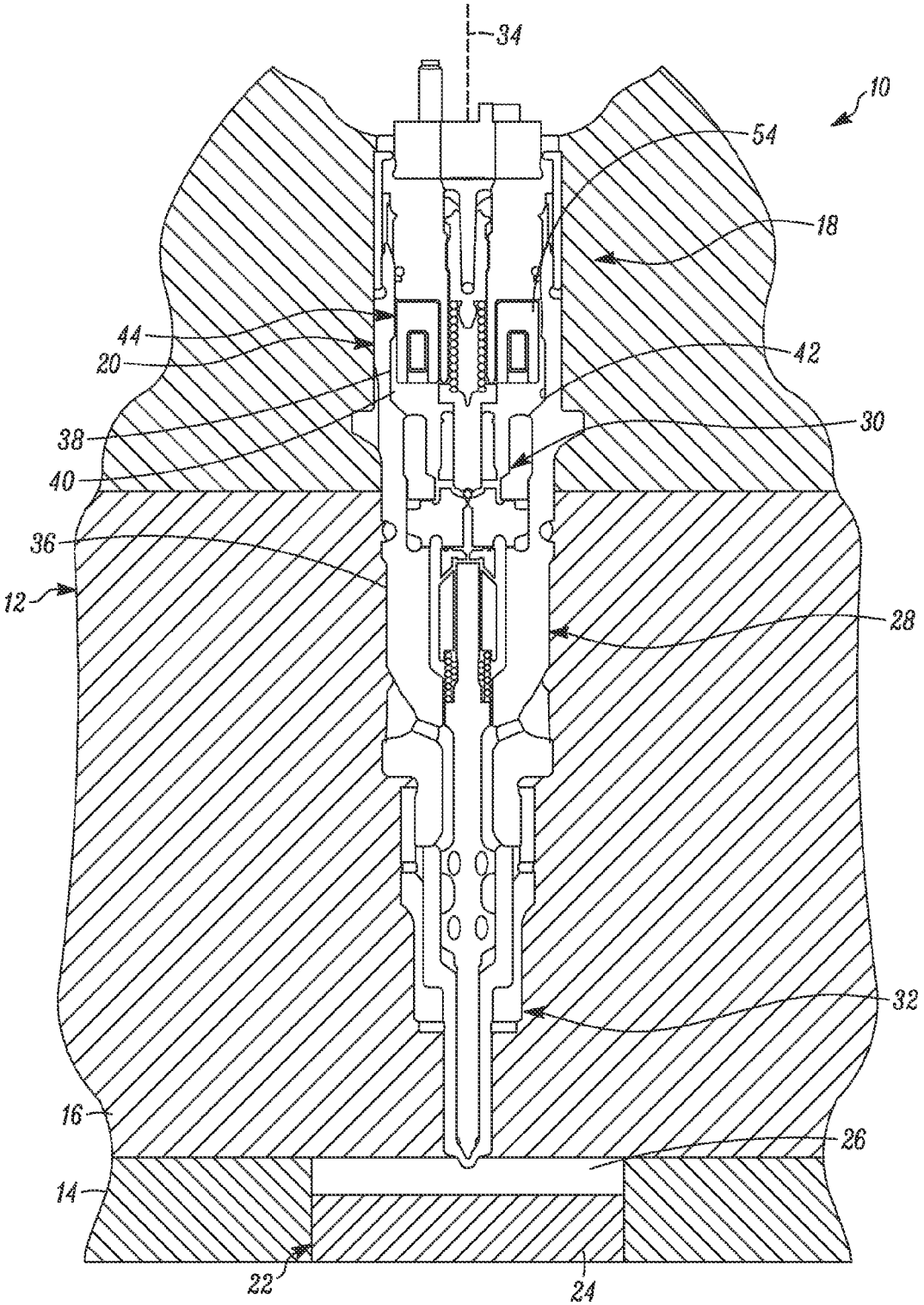
FIG. 1 is a cross-sectional view of a portion of an internal combustion engine incorporating a fuel injector in accordance with embodiments of the present disclosure.

Referring to FIG. 1, there is shown a portion of an internal combustion engine 10 in accordance with embodiments of the disclosure. Engine 10 includes an engine body 12, which includes an engine block 14 and a cylinder head 16 attached to engine block 14. Engine 10 also includes one or more fuel injectors 18. Engine body 12 includes a mounting bore 20, one or more cylinders 22, one or more pistons 24, and one or more combustion chambers 26. Mounting bore 20 is sized to receive fuel injector 18. Fuel injector 18 is adapted to inject metered quantities of fuel into combustion chamber 26 of engine 10 in timed relation to the reciprocation of piston 24. Each cylinder 22 may include a piston 24 positioned therein for reciprocal motion. Each combustion chamber 26 is formed by cylinder head 16, piston 24, and the exposed portion of cylinder 22 that extends between piston 24 and cylinder head 16. Throughout this disclosure, the terms "inwardly," "distal," and "near" refer to a location and/or direction that is longitudinally in the direction of combustion chamber 26. The terms "outwardly," "proximal," and "far" refer to a location and/or direction that is longitudinally away from the direction of combustion chamber 26.

Fuel injector 18 includes an injector body 28, an injection control valve assembly 30, a nozzle module 32 and a longitudinal axis 34. In embodiments, the structural and functional details of fuel injector 18 may be similar to those are disclosed in U.S. Pat. Nos. 5,676,114, 6,155,503, and 7,156,368, the entire contents of which are hereby incorporated by reference. Injector body 28 may include an outer housing 36, which secures injection control valve assembly 30, nozzle module 32, and other elements of fuel injector 18 in a fixed relationship, and a valve housing 38. Valve housing 38 includes a valve cavity 40 for receiving injection control valve assembly 30. Injection control valve assembly 30 is adapted to receive a control signal from a controller (not shown) to energize, which causes nozzle module 32 to permit fuel flow into combustion chamber 26. Injection control valve assembly 30 includes valve housing 38 having valve cavity 40 formed by a valve housing interior surface 42, and a fuel injector control valve 44 positioned within valve cavity 40.

Figure 2:
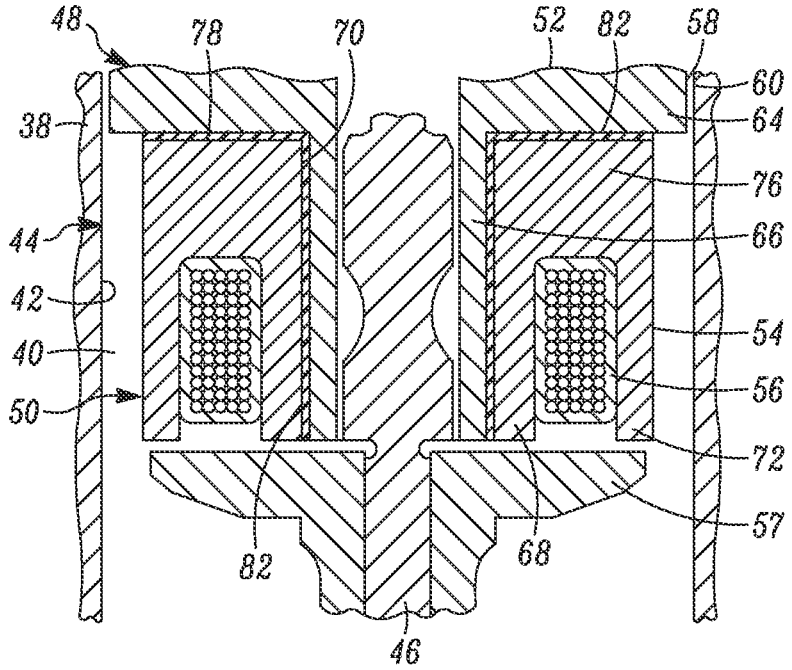
FIG. 2 is a cross-sectional view of a fuel injector actuator in accordance with embodiments of the present disclosure.

Referring now to FIG. 2, a portion of a fuel injector control valve 44 in accordance with embodiments of the present disclosure is shown. Injector control valve 44 includes a control valve member 46 and an actuator 48 positioned in valve housing 38 to cause movement of control valve member 46. Control valve member 46 is positioned in valve cavity 40 to move reciprocally between an open position permitting fluid flow and a closed position blocking fluid flow. Actuator 48 includes a solenoid assembly 50 that includes a stator housing 52, a stator core 54, an annular coil assembly 56 positioned circumferentially in and around stator core 54, and an armature 57 operably connected to control valve member 46. Stator housing 52 includes a stator housing exterior surface 58. An annular gap 60 may be included between exterior surface 58 of stator housing 52 and valve housing interior surface 42. Stator core 54 is positioned on stator housing 52, and in the exemplary embodiment, stator core 54 is secured to stator housing 52. As described further below, stator core 54 is positioned a spaced distance from fuel injector body 28 and from stator housing 52.

Stator housing 52 includes a first portion 64 and a second, inner stator housing portion 66 extending longitudinally therefrom. As best seen in FIG. 5, stator core 54 includes a first annulated wall 68 having an inner surface 70, a second annulated wall 72 having an outer surface 74, a radially extending wall 76 connecting first annulated wall 68 to second annulated wall 72 and having a transverse exterior surface 78, and a radially extending slot 80 extending through first annulated wall 68, radially extending wall 76, and second annulated wall 72. In embodiments, radially extending slot 80 may provide a break or opening in the annular form of stator core 54 because, for example, slot 80 may be configured to remove all material from a center of stator core 54 to a periphery of stator core 54 at one azimuthal or circumferential location. According to embodiments, the width of radially extending slot 80 is configured to be sufficient to prevent electric current from travelling across slot 80. In embodiments, for example, the width of slot 80 may be about one millimeter, which may provide ease of machinability, inspection, and reception of a potting or plastic molding material inside slot 80.

As shown in FIG. 2, annular coil assembly 56 is positioned between first annulated wall 68 and second annulated wall 72. An electrically insulating material 82 may be positioned between exterior surface 78 of radially extending wall 76 and first portion 64 of stator housing 52, and between inner surface 70 of first annulated wall 68 and second portion 66 of stator housing 52, which, in the illustrated embodiments, is perpendicular to exterior surface 78 and radially extending wall 76. Electrically insulating material 82 may be a dielectric material, which increases the voltage required to cause electrical breakdown, meaning there is less tendency for current to flow across the insulating boundary. In the figures, for clarity, electrically insulating material 82 is shown as being thicker than it may actually be in various implementations. Thus, in embodiments, electrically insulating material 82 positions stator core 54 a spaced distance from stator housing 52, and interposes a dielectric insulating material 82 in that space.

According to embodiments, electrically insulating material 82 may be an epoxy applied to the inner surface 70 of first annulated wall 68 (or a portion thereof) and to the exterior surface 78 of radially extending wall 76 (or a portion thereof). For example, electrically insulating material 82 may be applied to every portion of inner surface 70 and every portion of exterior surface 78 that could provide a path for electrical current to stator housing 52 when stator core 54 is positioned on stator housing 52. That is, in embodiments, electrically insulating material 82 may be applied to all longitudinally extending locations on inner surface 70 that are adjacent to a surface of stator housing 52 and all radially extending locations on exterior surface 78 that are adjacent to a surface of stator housing 52. As shown in FIG. 2, stator core 54 is positioned on stator housing 52, separated by electrically insulating material 82, forming a subassembly. In embodiments, the subassembly may be configured to be capable of passing a hi-pot test between stator core 54 and stator housing 52, which may mean that material 82 is electrically non-conductive. Electrically insulating material 82 may also be configured to be capable of preventing eddy currents from crossing radially extending slot 80. In embodiments, for example, insulating material 82 may be approximately 0.2 millimeters thick, with a dielectric strength greater than 10 kV/mm.

Figure 3:
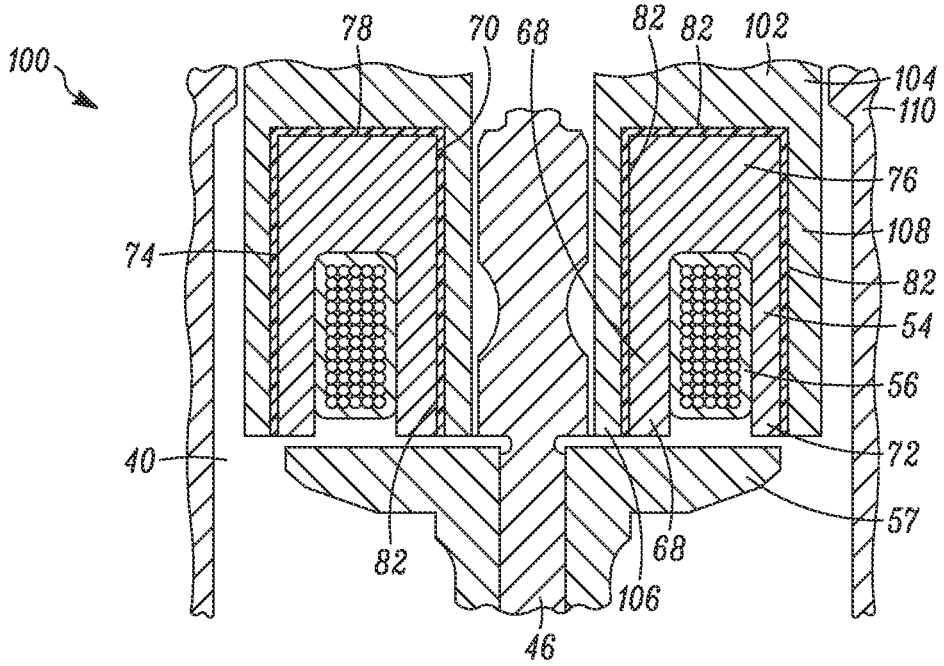
FIG. 3 is a cross-sectional view of another fuel injector actuator in accordance with embodiments of the present disclosure.

Referring now to FIG. 3, a portion of fuel injector control valve 100 in accordance with embodiments of the present disclosure is shown. Components similar or identical to components depicted in FIGS. 1 and 2 are provided with the same reference numbers for the purposes of clarity, though embodiments may include varying configurations, components, and/or the like. Fuel injector control valve 100 includes a stator housing 102, which includes a first portion 104, an inner stator housing portion 106, and an outer stator housing portion 108. Fuel injector control valve 100 is secured in a fuel injector body 110. In the illustrated embodiments, inner stator housing portion 106 and outer stator housing portion 108 are in the form of an annulus, but they may be segments or other configurations that position stator core 54. Inner stator housing portion 106 and outer stator housing portion 108 extend longitudinally from first portion 104 of stator housing 102. Electrically insulating material 82 is positioned between exterior surface 78 of radially extending wall 76 and first portion 104 of stator housing 102, between inner surface 70 of first annulated wall 68 and inner stator housing portion 106 of stator housing 102, and between outer surface 74 of second annulated wall 72 and outer stator housing portion 108. Thus, electrically insulating material 82 may position stator core 54 a spaced distance from stator housing 102.

In embodiments, electrically insulating material 82 may be an epoxy applied to the inner surface 70 of first annulated wall 68 (or a portion thereof), to the exterior surface 78 of radially extending wall 76 (or a portion thereof), and to the outer surface 74 of second annulated wall 72 (or a portion thereof). For example, electrically insulating material 82 may be applied to every portion of inner surface 70, outer surface 74, and exterior surface 78 that could provide a path for electrical current to stator housing 102 when stator core 54 is positioned on stator housing 102. This may include, in embodiments, all longitudinally extending locations on inner surface 70 that are adjacent to a surface of stator housing 102, all radially extending locations on exterior surface 78 that are adjacent to a surface of stator housing 102, and all longitudinally extending locations on outer surface 74 that are adjacent to a surface of stator housing 102. To verify the efficacy and integrity of the electrically insulating material 82, a hi-pot test may be performed on a subassembly that includes stator housing 102, stator core 54, and electrically insulating material 82, prior to installation of the subassembly in fuel injector 18.

Figure 4:
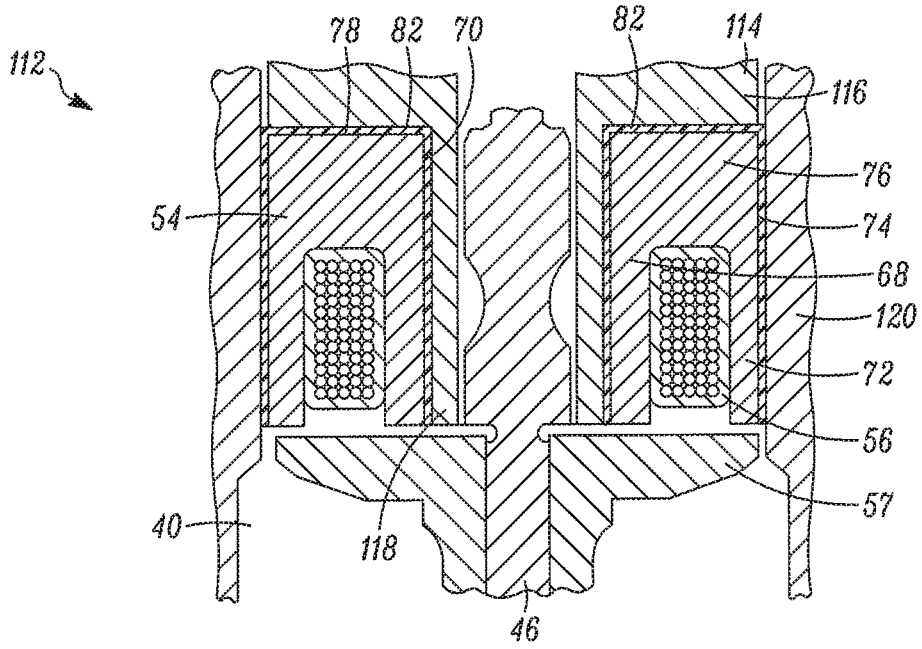
FIG. 4 is a cross-sectional view of another fuel injector actuator in accordance with embodiments of the present disclosure.

Referring now to FIG. 4, a portion of a fuel injector control valve 112 in accordance with embodiments of the present disclosure is shown. Components similar or identical to components depicted in FIGS. 1-3 are provided with the same reference numbers for the purposes of clarity, though embodiments may include varying configurations, components, and/or the like. Fuel injector control valve 112 includes a stator housing 114, which includes a first portion 116, and an inner stator housing portion 118. Fuel injector control valve 112 is secured in a fuel injector body 120, which in the illustrated embodiment includes a valve housing. In the illustrated embodiments, inner stator housing portion 118 is in the form of an annulus, but inner stator housing portion 118 may be segments or other configurations that position stator core 54. In FIG. 4, inner stator housing portion 118 extends longitudinally from first portion 116 of stator housing 114. Electrically insulating material 82 may be, as shown, positioned between exterior surface 78 of radially extending wall 76 and first portion 116 of stator housing 114, between inner surface 70 of first annulated wall 68 and inner stator housing portion 118 of stator housing 114, and between outer surface 74 of second annulated wall 72 and fuel injector body 120. Thus, electrically insulating material 82 may position stator core 54 a spaced distance from stator housing 114.

In embodiments, electrically insulating material 82 may be an epoxy applied to the inner surface 70 of first annulated wall 68 (or a portion thereof), to the exterior surface 78 of radially extending wall 76 (or a portion thereof), and to the outer surface 74 of second annulated wall 72 (or a portion thereof). That is, for example, electrically insulating material 82 may be applied to any portion of inner surface 70, outer surface 74, and exterior surface 78 that could provide a path for electrical current to stator housing 114 or to injector body 120 when stator core 54 is positioned on stator housing 114. In embodiments, electrically insulating material 82 may be applied at all longitudinally extending locations on inner surface 70 that are adjacent to a surface of stator housing 114, all radially extending locations on exterior surface 78 that are adjacent to a surface of stator housing 114, and all longitudinally extending locations on outer surface 74 that are adjacent to a surface of injector body 120. In embodiments, to verify the efficacy and integrity of the electrically insulating material 82, a hi-pot test may be performed on a subassembly that includes stator housing 114, stator core 54, and electrically insulating material 82, prior to installation of the subassembly in fuel injector 18.

While the embodiments of FIGS. 3 and 4 show electrically insulating material 82 along inner surface 70 and outer surface 74, constraint of stator core 54 may be achieved along either inner surface 70 or outer surface 74 adjacent to either the stator housing or the fuel injector body, with electrically insulating material 82 positioned therebetween, to properly position stator core 54.

Providing electrically insulating material 82, as described in various embodiments, may prevent formation of eddy currents in the stator cores of the various embodiments. These eddy currents may delay the transition of control valve member 46 between the closed and open positions and the open and the closed positions. In embodiments, the addition of insulating material at locations as described herein, may decrease the transition time between the closed and open positions by approximately 50%, which may improve control of fuel into combustion chamber 26.

Figure 5A:
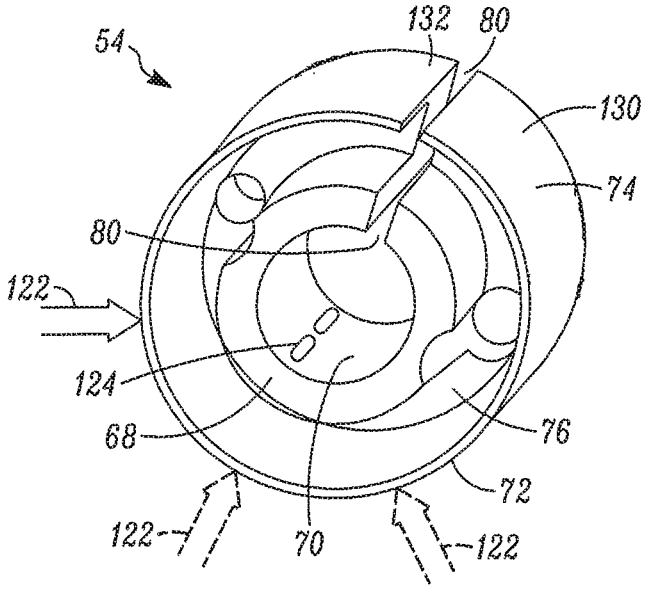
FIGS. 5A-C are perspective views of a stator core with an annular coil assembly removed in accordance with embodiments of the present disclosure.
Figure 5B:
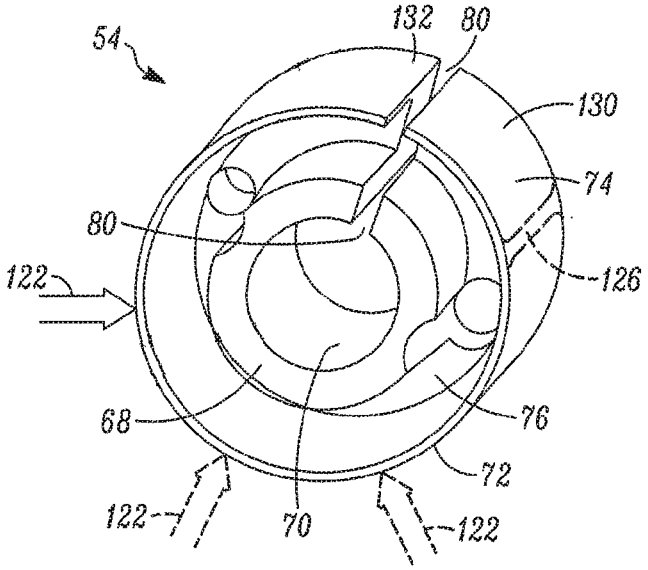
Figure 5C:
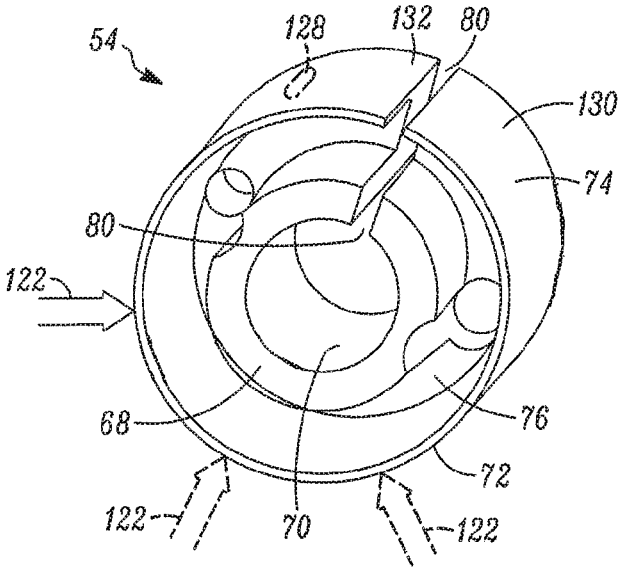

According to embodiments, limiting contact between the stator core and the stator housing, fuel injector body, and/or valve housing, to only one azimuthal or circumferential location on the stator core also may provide similar advantages, since such contact at one azimuthal or circumferential location keeps all other annulated surface portions or azimuthal locations of the stator core a spaced distance from the injector body and the stator housing and keeps the stator core electrically isolated at all annulated surface portions or locations on the fuel injector body and the stator housing, except at the contact location. In this manner, because the contact location is at one azimuthal location, no electrical path exists which would allow eddy currents to circumvent slot 80. Referring to FIGS. 5A-C, a bias force 122 may be applied to stator core 54 during assembly, which, depending on the configuration of the stator housing, the fuel injector body, and the valve housing, may result in only one azimuthal contact location between stator core 54 and one of the stator housing, the fuel injector body, and the valve housing. The azimuthal contact may be, for example, at a first azimuthal location 124 on inner surface 70 (FIG. 5A), a second azimuthal location 126 on outer surface 74 (FIG. 5B), or a third azimuthal location 128 on outer surface 74 (FIG. 5C).

The contact at the azimuthal location may be a relatively small area, such as a single non-linear contact location shown at third azimuthal location 128 (FIG. 5C), which may be described as a point contact though the actual contact area is physically larger than a literal point. The contact at the azimuthal location may be a longitudinally extending contact, such as shown at second azimuthal location 126 (FIG. 5B) and which may be described as a continuous, longitudinally extending line. The contact at the azimuthal location may be a plurality of contact points, which may be a plurality of non-linear contact locations, extending longitudinally or axially along either inner surface 70 or outer surface 74, as shown at first azimuthal location 124 (FIG. 5A). According to embodiments, these contact points may prevent an electrical circuit from being formed from a first portion 130 that is on a first side of radially extending slot 80 to a second portion 132 that is on a second side of radially extending slot 80. Such circuit may allow the flow of eddy currents around slot 80, thereby mitigating various benefits facilitated by embodiments of the present disclosure. Thus, in embodiments, contact may be permitted at only one azimuthal location on stator core 54. It should be apparent and understood that bias force 122 may be applied in any one or more of a number of azimuthal locations, and the locations shown in FIGS. 5A-C are examples only.

Figure 6A:
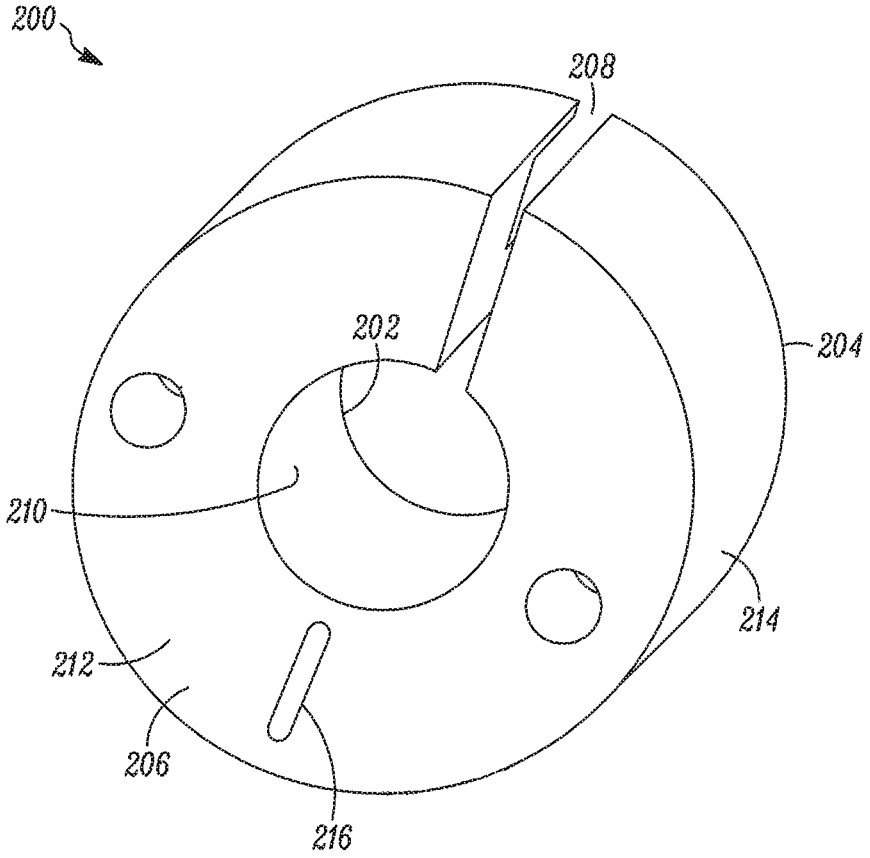
FIGS. 6A-B are perspective views of a stator core in accordance with embodiments of the present disclosure.
Figure 6B:
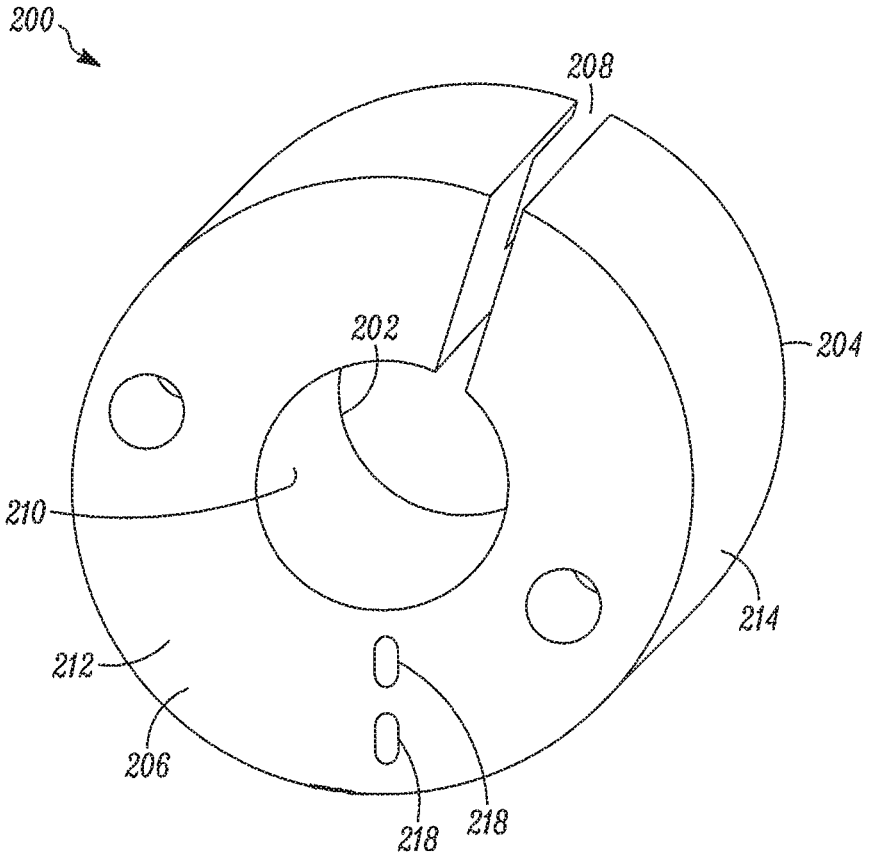

Referring to FIGS. 6A-B, a stator core 200 is shown in accordance with an exemplary embodiment of the present disclosure. Stator core 200 is shown in a perspective view from a proximal end, and includes first annulated wall 202, second annulated wall 204, radially extending wall 206 that extends from first annulated wall 202 to second annulated wall 204, and radially extending slot 208 that extends through the first annulated wall 202, the second annulated wall 204, and the radially extending wall 206. First annulated wall 202 includes an inner surface 210, radially extending wall 206 includes a transversely extending surface 212, and second annulated wall 204 includes an outer surface 214. One or more radially extending protrusions 216, 218 may be located on transversely extending surface 212 to space transversely extending surface 212 from stator housing (e.g., stator housing 102 depicted in FIG. 3). The radially extending protrusions 216, 218, may be positioned at only one circumferential or azimuthal location on transversely extending surface 212, and also may confer various benefits of the present disclosure where protrusion(s) extend to only one side of the stator core axis.

In embodiments, the protrusion 216 may be linear. In embodiments, the protrusions 218 may be a series of protrusions 218. Such contact may tend to tip stator core 200, which may create contact points at other locations on stator core 200. To maintain the position of stator core 200 with respect to the stator housing or the fuel injector body, an adhesive may be applied to inner surface 210, outer surface 214, and transversely extending surface 212, as appropriate to the embodiment, and stator core 200 may be held in position until the adhesive dries or cures, which would thus fix the position of stator core 200. In embodiments, the adhesive may be the epoxy described above. In embodiments, to hold stator core 200 in place, a non-electrically conductive shim may be used to wedge stator core 200 against one of the annulated surfaces of stator housing 52, 102, or 114, or against injector body 120.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. A fuel injector, comprising:

a fuel injector body;

a stator housing positioned in the fuel injector body; and a stator core positioned in the fuel injector body and including an inner surface, an outer surface, a radially extending slot extending from the inner surface to the outer surface, a transversely extending surface, and an annular coil assembly positioned on the stator core between the inner surface and the outer surface, the stator core being configured to contact one of:

a) the stator housing at only one azimuthal location on the inner surface, wherein the one azimuthal location on the inner surface is defined between a first azimuthal endpoint and a second azimuthal endpoint, and wherein the stator core is configured to contact the stator housing along the one azimuthal location at an axial position on the stator core;

b) the stator housing at only one azimuthal location on the outer surface, wherein the one azimuthal location on the outer surface is defined between a first azimuthal endpoint and a second azimuthal endpoint, and wherein the stator core is configured to contact the stator housing along the one azimuthal location at an axial position on the stator core;

c) the fuel injector body at only one azimuthal location on the outer surface, wherein the one azimuthal location on the outer surface is defined between a first azimuthal endpoint and a second azimuthal endpoint, and wherein the stator core is configured to contact the fuel injector body along the one azimuthal location at an axial position on the stator core; and d) the stator housing at only one azimuthal location on the transversely extending surface, wherein the one azimuthal location on the transversely extending surface is defined between a first azimuthal endpoint and a second azimuthal endpoint, and wherein the stator core is configured to contact the stator housing along the one azimuthal location at a radial position on the stator core.

2. The fuel injector of claim 1, wherein the contact at the azimuthal location extends longitudinally along the stator core.

3. The fuel injector of claim 2, wherein the contact at the azimuthal location forms a continuous, longitudinally extending line.

4. The fuel injector of claim 1, wherein the stator core is electrically isolated from the stator housing and the fuel injector body except at the azimuthal contact location.

5. The fuel injector of claim 4, wherein the electrical isolation includes an electrically insulating material positioned between at least the stator core and the stator housing.

6. The fuel injector of claim 4, wherein the electrical isolation includes electrically insulating material adhered to the stator core on at least two surfaces extending perpendicular to each other.

7. The fuel injector of claim 4, wherein the electrical isolation includes an electrically insulating material separating the radially extending wall exterior surface from the stator housing, and separating at least one of:

a) the first annulated wall from the inner stator housing portion along an extent of the first annulated wall;

b) the second annulated wall from the outer stator housing portion along an extent of the second annulated wall;

c) the second annulated wall from the injector body along an extent of the second annulated wall; and d) the transversely extending surface from the stator housing along an extent of the transversely extending surface.

8. The fuel injector of claim 1, wherein the contact at the one azimuthal location includes at least two points of contact positioned longitudinally along the stator core.

9. A method for making a fuel injector having reduced eddy currents, the method comprising:

positioning a stator housing and a stator core in a fuel injector body of the fuel injector, the stator core including a slot extending radially through the stator core from an inner surface of the stator core through an outer surface of the stator core, and the stator core including a transversely extending surface positioned adjacent to the stator housing; and positioning the stator core in contact with one of:

a) the stator housing at only one azimuthal location on the inner surface, wherein the one azimuthal location on the inner surface is defined between a first azimuthal endpoint and a second azimuthal endpoint, and wherein the stator core is configured to contact the stator housing along the one azimuthal location at an axial position on the stator core;

b) the stator housing at only one azimuthal location on the outer surface, wherein the one azimuthal location on the outer surface is defined between a first azimuthal endpoint and a second azimuthal endpoint, and wherein the stator core is configured to contact the stator housing along the one azimuthal location at an axial position on the stator core;

c) the fuel injector body at only one azimuthal location on the outer surface, wherein the one azimuthal location on the outer surface is defined between a first azimuthal endpoint and a second azimuthal endpoint, and wherein the stator core is configured to contact the fuel injector body along the one azimuthal location at an axial position on the stator core; and d) the stator housing at only one azimuthal location on the transversely extending surface, wherein the one azimuthal location on the transversely extending surface is defined between a first azimuthal endpoint and a second azimuthal endpoint, and wherein the stator core is configured to contact the stator housing along the one azimuthal location at a radial position on the stator core.

10. The method of claim 9, further comprising securing the stator core in position with an adhesive.

11. The method of claim 9, further comprising providing a bias to the stator core during an assembly process to position the stator core; and securing stator core to at least one of the stator housing and the injector body with an adhesive.

12. The method of claim 9, wherein the contact at the azimuthal location extends longitudinally along the stator core.

13. The method of claim 12, wherein the contact at the azimuthal location forms a continuous, longitudinally extending line along the stator core.

14. The method of claim 9, further comprising electrically isolating the stator core from the stator housing and the fuel injector body except at the azimuthal contact location.

15. The method of claim 14, wherein said electrically isolating includes positioning an electrically insulating material between at least the stator core and the stator housing.

16. The method of claim 14, wherein said electrically isolating includes adhering an electrically insulating material to the stator core on at least two surfaces extending perpendicular to each other.

17. The method of claim 14, wherein said electrically isolating includes providing an electrically insulating material separating the radially extending wall exterior surface from the stator housing, and separating at least one of:

a) the first annulated wall from the inner stator housing portion along an extent of the first annulated wall;

b) the second annulated wall from the outer stator housing portion along an extent of the second annulated wall;

c) the second annulated wall from the injector body along an extent of the second annulated wall; and d) the transversely extending surface from the stator housing along an extent of the transversely extending surface.

18. The method of claim 9, wherein the contact at the one azimuthal location includes at least two points of contact positioned longitudinally along the stator core.

* * * * *